US011953018B2

(12) United States Patent
Malone

(10) Patent No.: US 11,953,018 B2
(45) Date of Patent: Apr. 9, 2024

(54) MULTI-SWITCH PUMP ASSEMBLY

(71) Applicant: COOPER-STANDARD AUTOMOTIVE INC, Northville, MI (US)

(72) Inventor: David S. Malone, Attica, MI (US)

(73) Assignee: Cooper-Standard Automotive Inc., Northville, MI (US)

( * ) Notice: Subject to any disclaimer, the term of this patent is extended or adjusted under 35 U.S.C. 154(b) by 0 days.

(21) Appl. No.: 17/712,837

(22) Filed: Apr. 4, 2022

(65) Prior Publication Data

US 2023/0313809 A1 Oct. 5, 2023

(51) Int. Cl.

| | |
|---|---|
| ***F04D 27/00*** | (2006.01) |
| ***F04D 17/12*** | (2006.01) |
| ***F04D 29/043*** | (2006.01) |

(52) U.S. Cl.

CPC ..... *F04D 27/004* (2013.01); *F04D 17/12* (2013.01); *F04D 29/043* (2013.01)

(58) Field of Classification Search

CPC ..... F04D 27/004; F04D 17/12; F04D 29/043
See application file for complete search history.

(56) References Cited

U.S. PATENT DOCUMENTS

| | | | |
|---|---|---|---|
| 4,679,983 | A | 7/1987 | Pietryk et al. |
| 10,823,175 | B2 | 11/2020 | Blad et al. |
| 2021/0003133 | A1 | 1/2021 | Blad et al. |

FOREIGN PATENT DOCUMENTS

| | | | | |
|---|---|---|---|---|
| CN | 204572469 U | * | 8/2015 | |
| CN | 204572469 U | | 8/2015 | |
| DE | 1653790 A1 | | 8/1971 | |
| KR | 102359325 B1 | * | 2/2022 | ..... F16K 31/043 |
| KR | 102359325 B1 | | 2/2022 | |

OTHER PUBLICATIONS

Machine Translation of KR102359325B1 PDF file name: "KR102359325B1_Machine_Translation.pdf".*
Machine Translation of CN204572469U PDF File Name: "CN204572469U_Machine_Translation.pdf".*
Search Report and Written Opinion for PCT/US2023/062891 dated Jun. 15, 2023.

* cited by examiner

*Primary Examiner* — Grant Moubry
*Assistant Examiner* — Ruben Picon-Feliciano
(74) *Attorney, Agent, or Firm* — Paschall & Associates, LLC; James C. Paschall; Anthony Miologos

(57) ABSTRACT

A multi-switch pump assembly is disclosed that facilitates switched flow and/or mixed flow from the pump assembly. The multi-switch pump assembly comprises a pump body, an electric motor, a rotating motor shaft, a first pump stage and impeller, and a second pump stage and impeller. The first pump stage includes a first inlet and first and second outlets disposed about the pump body. The second pump stage includes a second fluid inlet connected to a mix chamber. The mix chamber further connected to the second fluid outlet of the first pump stage. The second stage further includes a second and a third outlet disposed about the pump body. An actuator connected to a valve assembly is arranged to operate and place the valve assembly into at least a first, a second, a third and a fourth switched positions to direct fluid flow between the first and the second pump stages and the first, second, third and fourth fluid outlets.

19 Claims, 10 Drawing Sheets

MULTI-SWITCH PUMP ASSEMBLY

TECHNICAL FIELD

This disclosure is generally directed to pumps. More specifically, it relates to a multi-switch pump assembly that facilitates switched flow and/or mixed flow through the pump assembly.

BACKGROUND

Pumps are known and commonly used to move fluids, such as coolant in a vehicle. Vehicles include cooling circuits for cooling heat-generating components of a vehicle, such as for example a vehicle's battery bank (in electric and hybrid vehicles) and a vehicle's powertrain (e.g., antifreeze for combustion engine cooling). The waist heat drawn from the heat-generating components may be also circulated to heat the cabin of the vehicle when required. Currently known pumps are used to circulate coolant fluids between the heat-generating components and heat dissipating devices of a vehicle such as a radiator, heat exchanger or cabin heater. In currently known pump assemblies, this has been done using separate components such as fluid pumps and valves that switch or shift the coolant fluid circulating in a fluid circuit through various cooling circuits.

Individual valves could be potentially used to control flow from one or more pumps into one or more circuits. However, such systems require multiple valves and/or a complex valve assembly as well as control systems for selective actuation of the valves. A simplified system is desired that can integrate pumps and valves into a compact assembly that can switch or mix fluid flow between two or more cooling circuits.

SUMMARY

This disclosure relates to a multi-switch pump assembly that facilitates switched flow and/or mixed flow through the pump assembly.

In a first embodiment a pump assembly is disclosed comprising; a pump body and a first pump stage housed in the pump body having a first fluid inlet and a first and a second fluid outlet; a second pump stage housed in the pump body having a second fluid inlet and a third and a fourth fluid outlet; a mixing chamber housed in the pump body between the first and second pump stages in fluid communication with the second fluid inlet and the second fluid outlet; and a valve assembly. The valve assembly is operable into a first switched position to fluidically connect the first fluid inlet through the first pump stage to the first fluid outlet and to fluidically connect the mixing chamber through the second pump stage to the third fluid outlet. The valve assembly is further operable into a second switched position to fluidically connect the first fluid inlet through the first pump stage to the first fluid outlet and to fluidically connect the mixing chamber through the second pump stage to the fourth fluid outlet. Operating the valve assembly into a third switched position fluidically connects the first fluid inlet through the first pump stage to the second fluid outlet and to the mixing chamber, wherein the fluid from the second fluid inlet and the fluid from the second fluid outlet are mixed in the mixing chamber and fluidically connected through the second pump stage to the third fluid outlet. Operating the valve assembly into a fourth switched position fluidically connects the first fluid inlet through the first pump stage to the second fluid outlet to fluidically connect the mixed fluid through the second pump stage to the fourth fluid outlet.

In a second embodiment a method is disclosed for switching fluid flow through a pump assembly, the method comprising moving a valve assembly into a first switched position to fluidically connect a first fluid inlet and a first fluid source to a first pump stage having a first and a second fluid outlet. The first switched position fluidically connecting the first fluid outlet to the first pump stage, wherein the first pump stage pumps fluid from the first fluid source to the first fluid outlet. The method further includes fluidically connecting a mixing chamber to a second pump stage. The mixing chamber fluidically connected to a second fluid inlet and to a second fluid source. The second pump stage having third and fourth fluid outlets. The first switched position fluidically connects the third fluid outlet to the second pump stage, wherein the second pump stage pumps fluid from the second fluid source to the third fluid outlet. The method also includes moving the valve assembly into a second switched position fluidically disconnecting the second pump stage from the third fluid outlet and fluidically connecting the second pump stage to the fourth fluid outlet, wherein the fluid from the second fluid source is pumped to the fourth fluid outlet. The method additionally includes, moving the valve assembly into a third switched position to fluidically connect the first fluid inlet and the first fluid source to the second fluid outlet and to fluidically disconnect the first pump stage from the first fluid outlet. The first pump stage pumping fluid from the first fluid source to the mixing chamber where it is mixed with the fluid from the second fluid inlet and the second fluid source. The valve assembly in the third switched position fluidically connects the mixing chamber to the second pump stage and the third fluid outlet disconnecting the second pump stage from the fourth fluid outlet, wherein the second pump stage accelerates and boosts the mixed fluid to the third fluid outlet. The method further includes moving the valve assembly into a fourth switched position fluidically disconnecting the second pump stage from the third fluid outlet and fluidically connecting the second pump stage to the fourth fluid outlet, wherein the second pump stage accelerates and boosts the mixed fluid to the fourth fluid outlet.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
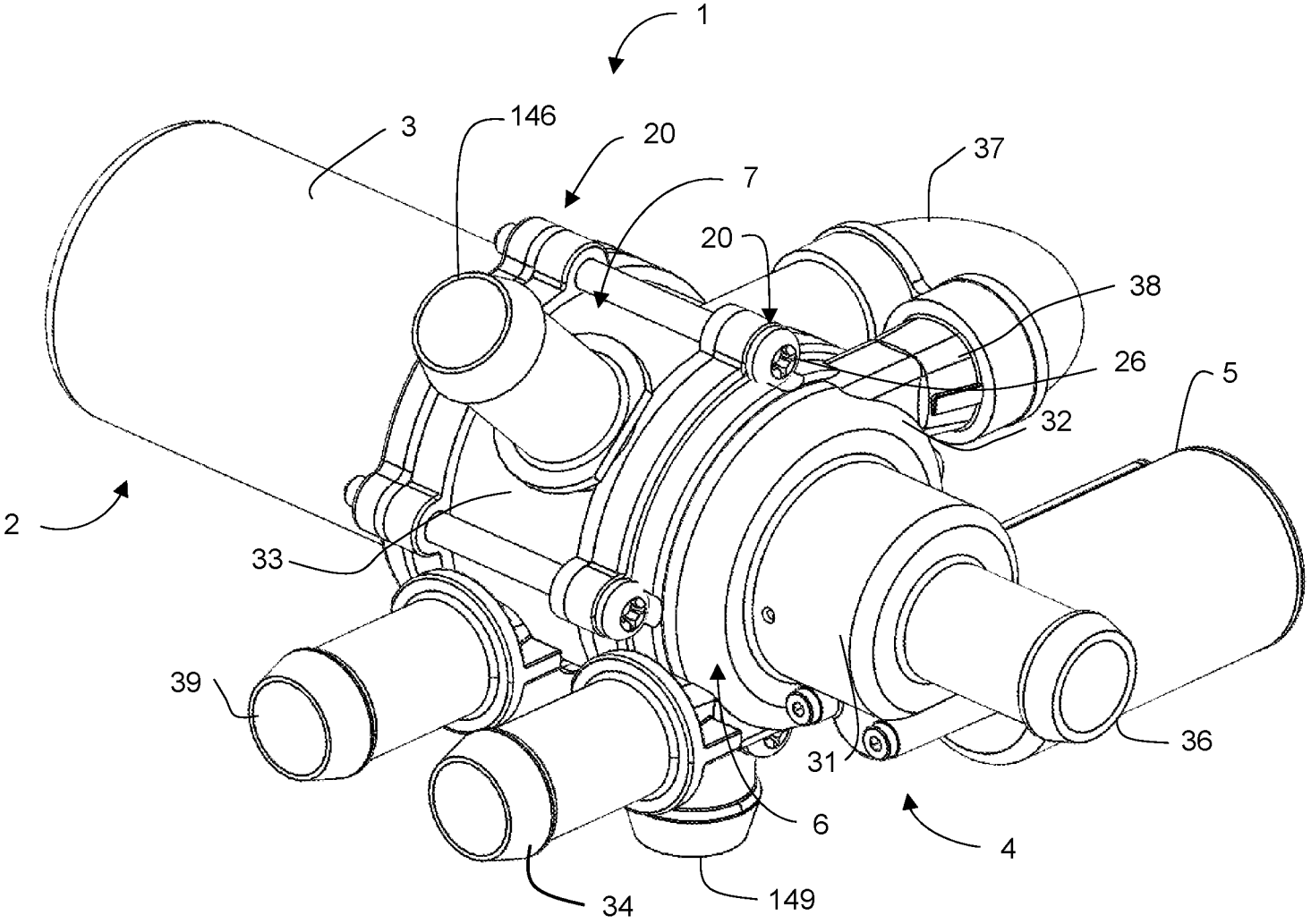
FIG. 1 illustrates a perspective view of an assembled pump assembly of the present disclosure.

The figures, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

An example assembly provides a multi-switch pump assembly that facilitates switched flow and/or mixed flow through the pump assembly. The multi-switch pump assembly comprises a pump body, an electric motor, a rotating motor shaft, a first pump stage and impeller, and a second pump stage and impeller. The first pump stage includes a first inlet and first and second outlets disposed about the pump body. The second pump stage includes a second fluid inlet, a fluid connection to the second fluid outlet of the first pump stage. The second stage further includes a second and a third outlet disposed about the pump body.

The first pump stage impeller and the second pump stage impeller are located on either side of a mixing chamber that is fluidically connected to the second fluid inlet of the second pump stage and the second fluid outlet of the first pump stage. The first pump stage impeller and the second stage pump impeller are connected to the motor shaft and rotated by the motor The first pump stage impeller in fluid communication with the first pump stage and the first and second fluid outlets and the second pump stage impeller is in fluid communication with the mixing chamber and the third and fourth fluid outlet.

An actuator connected to a valve assembly is arranged to operate and place the valve assembly into at least a first, a second, a third and a fourth switched position. The valve assembly switches and/or mixes fluid flowing in two fluid circuits through the pump assembly. In the first switched position a first valve member of the valve assembly opens the first fluid outlet and closes the second fluid outlet. Fluid in the first fluid circuit enters the first fluid inlet and is pumped by first pump stage impeller out of the first fluid outlet. In the first switched position a second valve member in the second pump stage opens the third fluid outlet and closes the fourth fluid outlet. Fluid in a second fluid circuit enters the second pump stage via the second fluid inlet to the mixing chamber and is pumped by the second pump stage impeller to the third fluid outlet. In the first switched position of the valve assembly the first and second fluid circuits are separately maintained to provide isolated looping through the fluid circuits to provide for example chilling of the fluid being circulated using a cooling device such as a radiator or a chiller.

Operating the actuator to place the valve assembly in the second switched position maintains the first pump stage second outlet closed, directing fluid out of the first fluid outlet. However, in the second switched position the second stage valve member closes the third fluid outlet and opens the fourth fluid outlet. In the second switched position the first and second fluid circuits are separately maintained to provide isolated looping through the fluid circuits. The first fluid circuit maintaining cooling of for example the vehicle battery in an electric vehicle while the second fluid circuit looped through a cabin heat exchanger to use waste heat from the battery to provide warming to the cabin.

Operating the actuator into the third switched position places the valve member of the first pump stage to close the first fluid outlet diverting the fluid to the second fluid outlet. Fluid from the first fluid circuit enters the first fluid inlet and is pumped into the mixing chamber by the first stage impeller. In the mixing chamber fluid from the first fluid circuit is mixed with fluid from the second fluid circuit entering the mixing chamber from the second fluid inlet. In the third switched position the second stage valve member closes the fourth fluid outlet and opens the third fluid outlet. The mixed fluid in the mixing chamber is pumped from the second pump stage by the second impeller to the third fluid outlet. In the third switched position the first and second fluid circuits are linked to provide for example cabin cooling and battery chilling from a chilling device.

In the fourth switched position fluid from the first fluid circuit is pumped from the first pump stage impeller to the second fluid outlet to the mixing chamber and mixed with the fluid from the second fluid circuit, however, in the fourth switched position the fourth fluid outlet is opened, and the third fluid outlet closed. The second pump stage impeller pumping the mixed fluid from the mixing chamber to the fourth fluid outlet. In the fourth switched position the first and second fluid circuits are linked to provide for example cabin heating using and waste heat from the battery or electric heater.

FIG. 1 illustrates an example multi-switch pump assembly 1 for pumping a fluid, such as a coolant, in a vehicle. As can be appreciated, the pump assembly 1 may also be used in non-vehicle applications. The example multi-switch pump assembly 1 is an integration of a two-stage pump and a valve for selectively providing switched flow and or mixed flow from the pump stages of the pump assembly 1.

Figure 2:
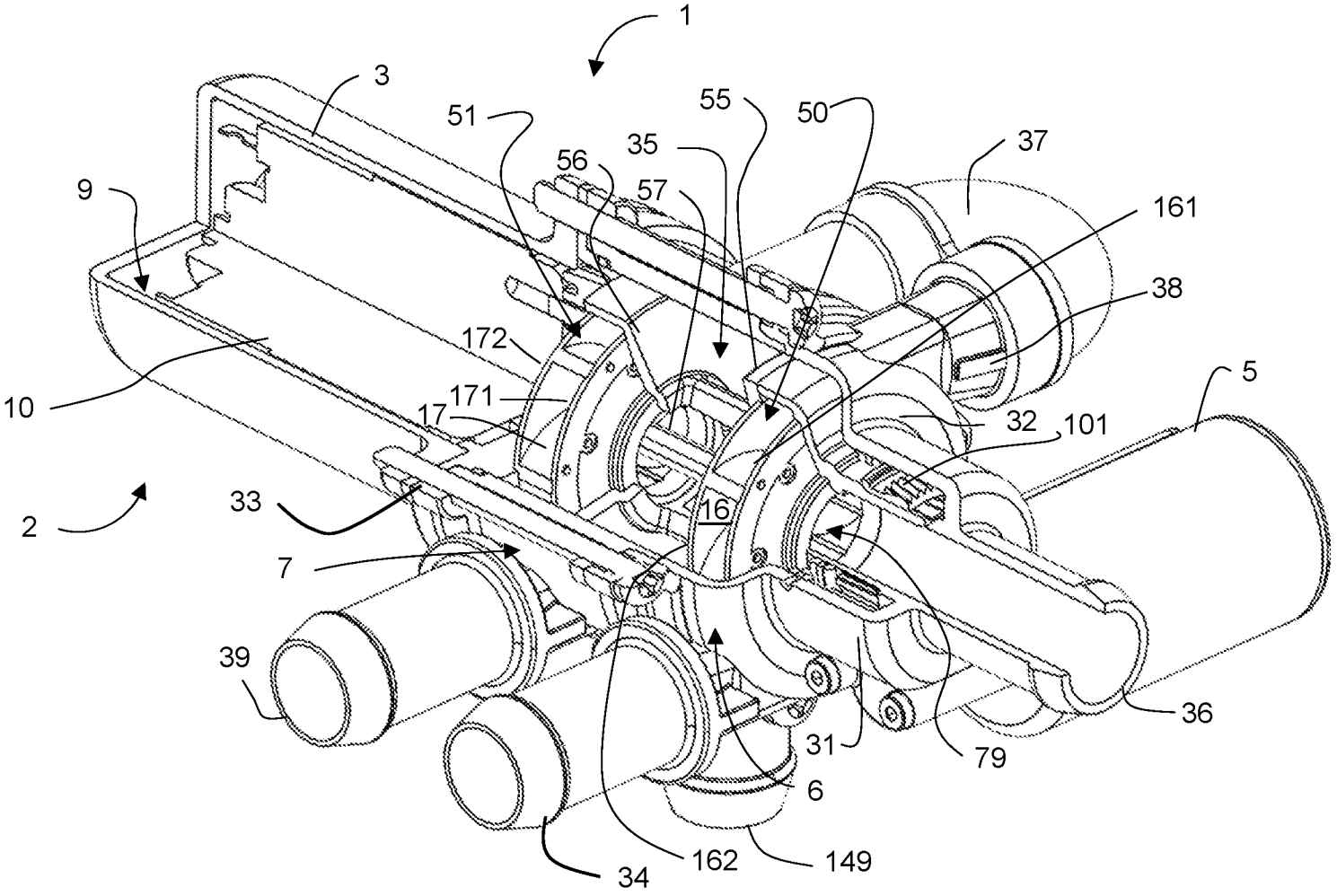
FIG. 2 illustrates a cross-sectional perspective view of the pump assembly of the present disclosure.
Figure 3:
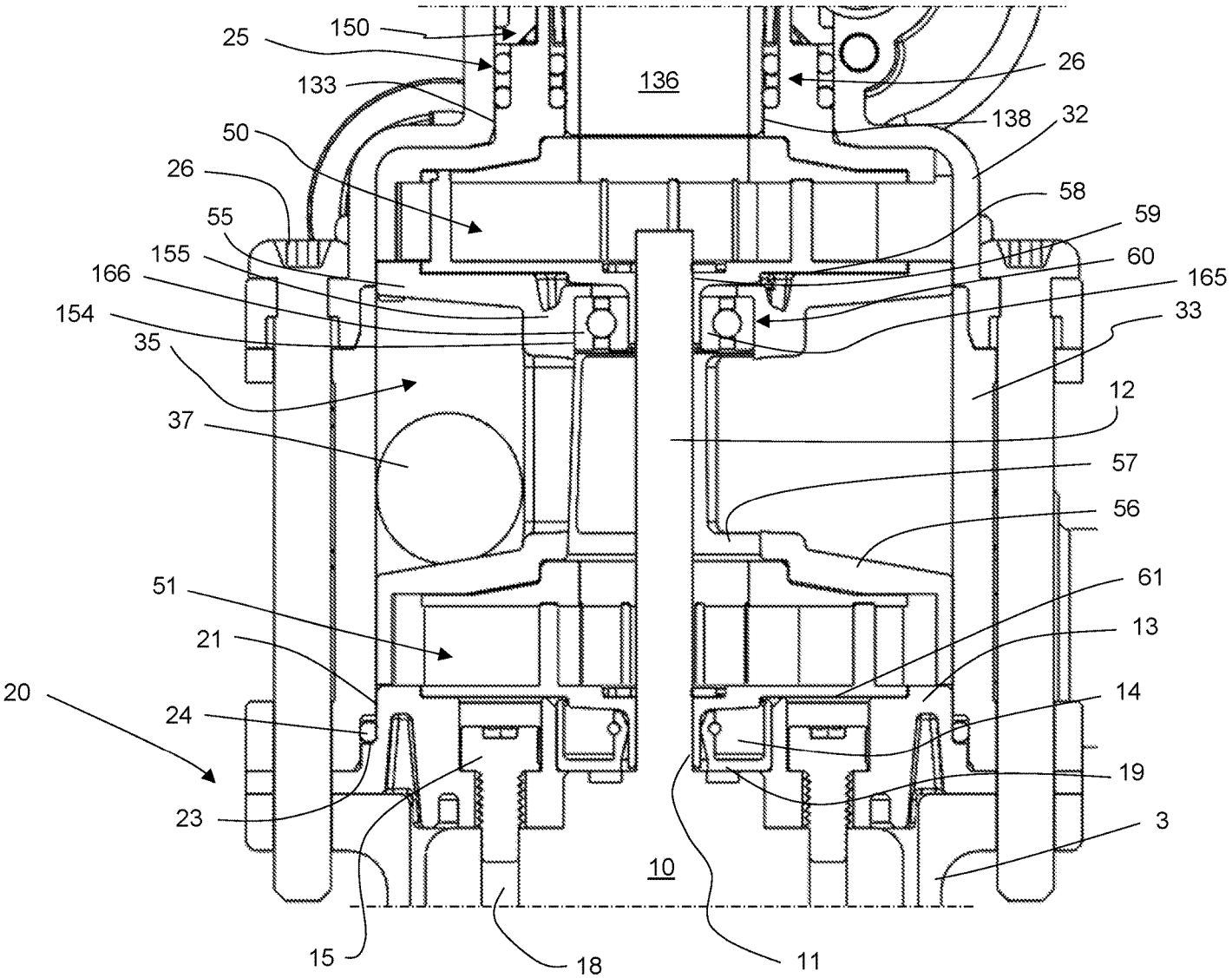
FIG. 3 illustrates a cross-sectional view through a portion of the assembled pump assembly of the present disclosure.

FIGS. 1-3, illustrate a pump assembly 1 having a pump motor section 2 and a pump section 4 comprised of a first pump stage 6 and a second pump stage 7. In the illustrated example of FIGS. 1 and 2, the first pump stage 6 is formed essentially cylindrical and comprises a peripheral exterior wall 32 surrounding a cylindrical first stage impeller cavity 50. A fluid inlet 36, for example a suction inlet receives a fluid, such as a vehicle coolant, is positioned centrally to the rotary axis of the first pump stage 6. The first pump stage 6 also includes at least a first and a second fluid outlet for discharging fluid from the first pump stage 6. A first fluid outlet 34 and a second fluid outlet 38 extend from the wall 32 orthogonal to the fluid inlet 36 and are axially offset from each other such that the centers of the first and second fluid outlets 34, 38, in the example, are oriented 180 degrees to the other. It will be appreciated by those skilled in the art, that fluid outlets 34, 38 may be offset from each other at any other convenient angle. Both fluid outlets 34, 38 are fluidly connected to the first impeller cavity 50.

The second pump stage 7 is also formed cylindrically and comprises a peripheral exterior wall 33 extending coaxially from exterior wall 32 of the first pump stage 6. Wall 33 surrounds a cylindrical second stage impeller cavity 51 and a cylindrical mixing chamber 35. A second fluid inlet 146, for example a suction inlet provides a fluid, to the mixing chamber 35. As is best seen in FIG. 3 the mixing chamber 35 is isolated from the first impeller cavity 50 by a thimble 55. A second thimble 56 separates the flow feed chamber 35 from the second pump stage second impeller cavity 51. The second thimble 56 includes an annular aperture 57 centrally located on the thimble 56 extending through the thimble 56 into the second impeller cavity 51. Aperture 57 acts as an inlet for fluid to enter the second impeller cavity 51 from the mixing chamber 35. The second fluid outlet 38 of the first pump stage 6 is connected to the mixing chamber 35 via an inlet loop 37 extending from exterior wall 33. Fluid discharged from the second fluid outlet 38 is channeled by inlet loop 37 and into mixing chamber 35. A third fluid outlet 39 and a fourth fluid outlet 149 extend from the wall 33 from the second impeller cavity 51. The third fluid outlet 39 and the fourth fluid outlet 149 extend from the wall 33 in this example 90 degrees to the other. It will be appreciated by those skilled in the art, that fluid outlets 39, 149 may be offset from each other at any other convenient angle.

The first impeller cavity 50 of the first pump stage 6 is arranged to house therein a first stage impeller 16 having a plurality of vanes mounted between a front vane plate 161 and a rear vane plate 162. The rear vane plate 162 is arranged to be mounted within a recess 58 of thimble 55. The recess 58 acting as a bearing surface for the impeller 16. A motor shaft 12 of a pump motor 10 extends through the mixing chamber 35 into an opening 59 through thimble 55 and attached to impeller 16 in any known convenient manner.

The second impeller cavity 51 of the second pump stage 7 is arranged to house therein a second stage impeller 17 having a plurality of vanes mounted between a first vane plate 171 and a rear vane plate 172. The rear vane plate 172 is arranged to be mounted within a recess 61 of a pump motor mounting plate 13. The recess 61 acting as a bearing surface for the second stage impeller 17. The motor shaft 12 extends through a pump motor mounting plate 13 and into the mixing chamber 35 to the first stage impeller 16 of the first pump stage 6. The motor shaft 12 is attached to the second stage impeller 17 in any convenient known manner. The second stage impeller 17 is configured to be rotatable within the second impeller cavity 51 of the second pump stage 7 driven by the pump motor 10. Since both impellers 16 and 17 are attached to the same motor shaft 12 they are both driven at the same rotational speed by the pump motor 10.

The pump motor section 2 includes a cylindrical motor housing 3 that forms a cylindrical motor cavity 9 therein. The pump motor housing 3 supports the pump motor 10 and a motor shaft 12 that is installed through an opening 11 of a pump motor mounting plate 13. The motor mounting plate 13 includes a wall 21 extending circumferentially from a top surface of the mounting plate 13. The wall 21 includes a shoulder 23 extending along and outer periphery of wall section 21. An elastomeric sealing element, such as for example an O-ring 24 is arranged to be installed on shoulder 23. A seal member 14 is installed within a seal seat 19 molded on mounting plate 13. The mounting plate 13 is secured to the pump motor 10, in this example, using threaded fasteners 15 that extend through holes in the mounting plate 13 to engage threaded holes 18 on the face of pump motor 10. The mounting plate seals the motor cavity 9 and pump motor 10 from the pump section 4.

The first pump stage 6 is assembled to the second pump stage 7 to form pump section 4 by attaching a rear portion of the exterior housing 32 of the first pump stage 6 to a front portion of the exterior housing 33 of the second pump stage 7 by using any method that provides a leak tight bond, such as for example, welding or using sealing elements such as gaskets or O-rings.

With the mounting plate 13 mounted on the pump motor 10 mounting tabs 20 located about the motor housing 3, the mounting plate 13 and the pump section 4 are brought together and the wall 21 is installed within an interior surface of a rear portion of the second pump stage 7. The O-ring 24 seals against the interior surface of the pump section 4 and wall 21. The mounting tabs 20 are aligned with each other to assemble and secure the motor section 2 to the pump section 4 using suitable fasteners 26. As can be appreciated, other types of fastening devices or techniques may be used to secure the pump section 4 and the motor section 2 together.

The pump motor 10 includes electrical connections (not shown) that extend from a rear portion of the motor 10 through a rear portion of motor housing 3. The electrical connections are adapted to receive electrical power from a remotely located power source to energize and operate the pump motor 10.

The valve assembly 40 of the present disclosure is illustrated in FIGS. 2-5. The valve assembly 40 is comprised of an adjustable first pump stage valve member 42 that is rotatably mounted outside the first stage impeller 16 and inside the first impeller cavity 50 of the first pump stage 6. The first pump stage valve member 42 is arranged to adjustably direct fluid through a respective first fluid outlet 34 or second fluid outlet 38. The valve member 42 includes an annular wall 45 with an exterior wall surface 49 and an interior wall surface 46 and a rectangular opening 44 extending through wall 45. In this example, wall 45 of the valve member 42 is spirally voluted from a generally thicker wall section at a first end 47 of opening 44 to a generally thinner wall section at a second end 48 of the opening 44. The first stage impeller 16 is arranged to rotate inside valve member 42 and the voluted interior wall surface 46.

Figure 4A:
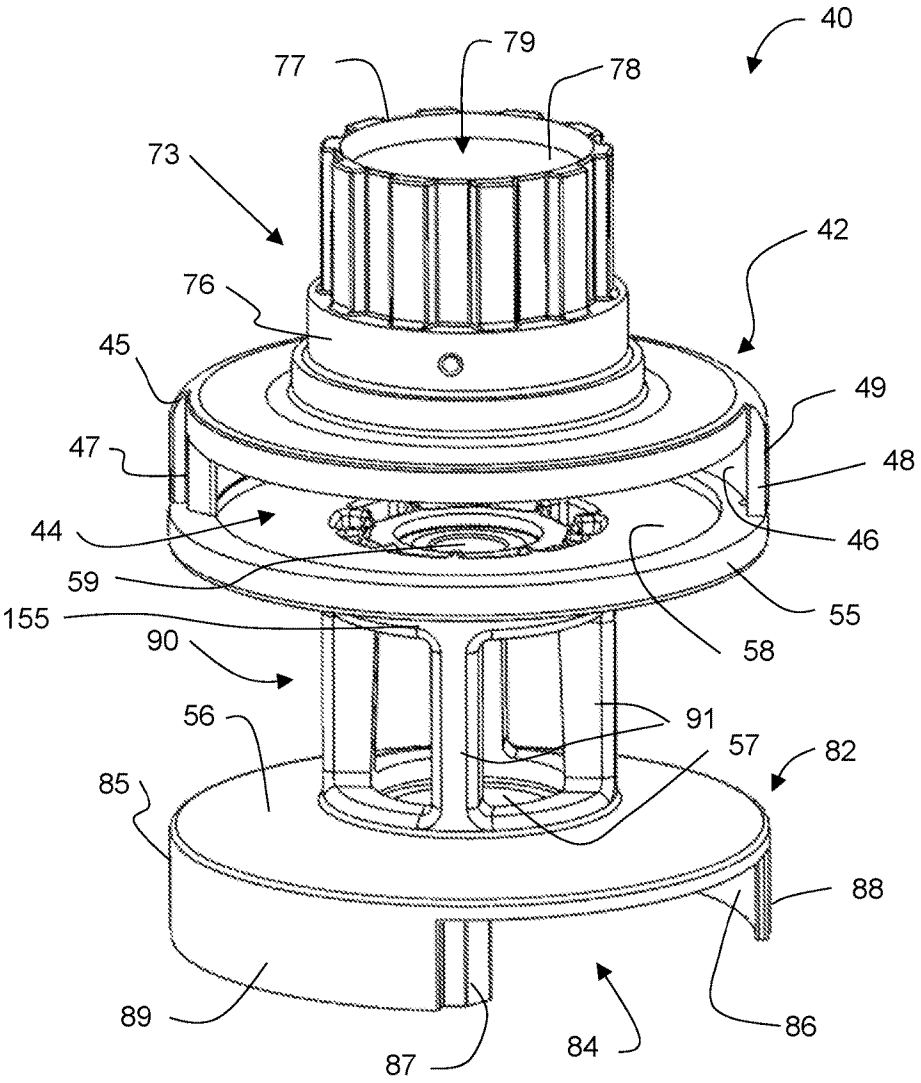
FIG. 4A illustrates a perspective view of the valve assembly of the present disclosure.
Figure 4B:
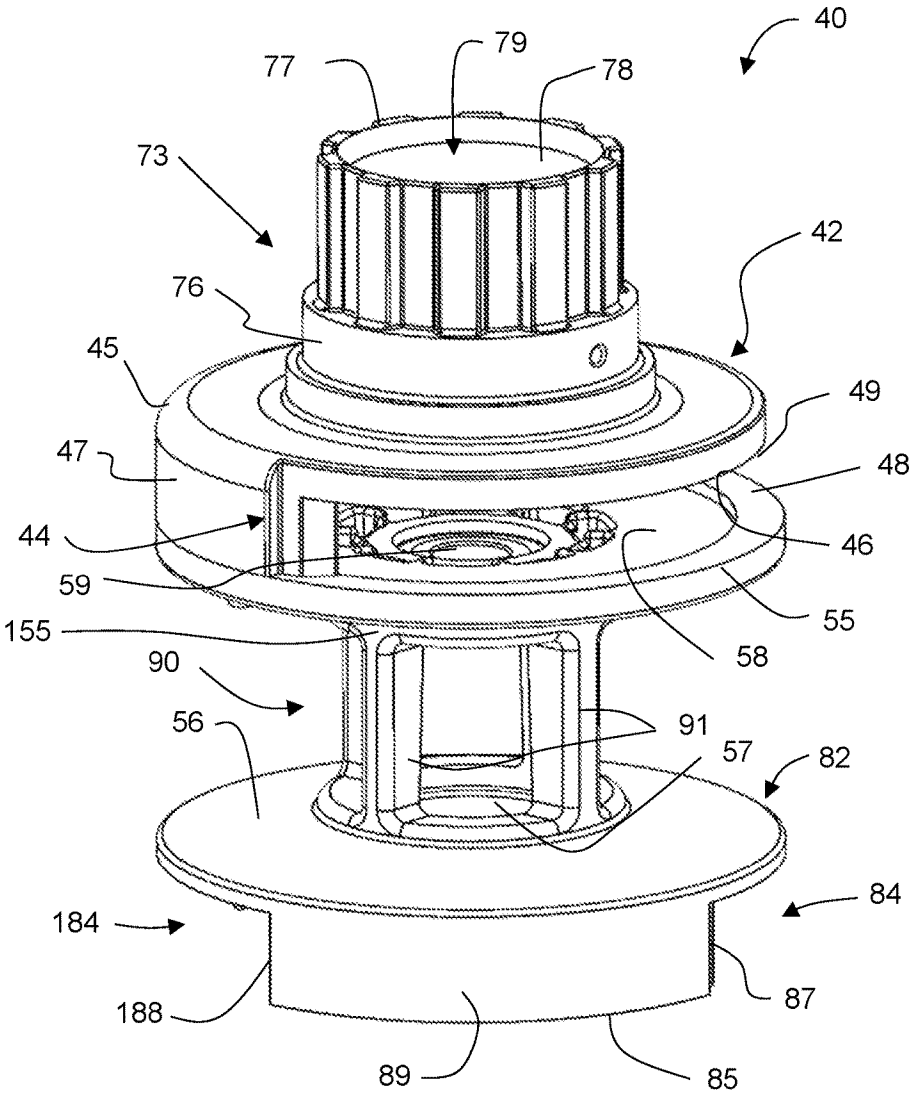
FIG. 4B illustrates a perspective view of the valve assembly of the present disclosure rotated 90 degrees.
Figure 5:
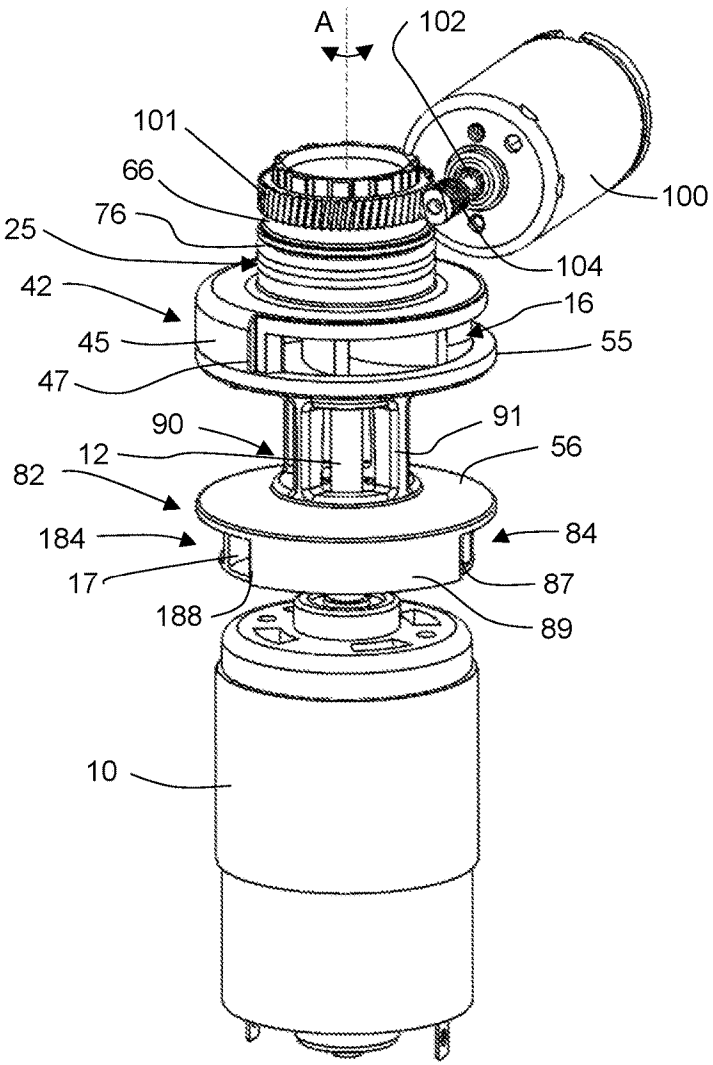
FIG. 5 illustrates a perspective view of the valve assembly, pump motor and actuator isolated from the pump housing of the present disclosure.

The valve assembly further includes an adjustable second pump stage valve member 82 that is radially mounted outside the second stage impeller 17 and inside the second impeller cavity 51 of the second pump stage 7. The second pump stage valve member 82 is arranged to adjustably open or close fluid flow through the third fluid outlet 39 and the fourth fluid outlet 149. The valve member 82 includes an annular wall 85 with an exterior wall surface 89 and an interior wall surface 86 and a first rectangular opening 84 and a second rectangular opening 184 each extending through wall 85. Each opening 84 and 184 are located on opposite sides of wall 89 facing each other, as is best seen in FIGS. 4B and 5. In this example, wall 85 of the valve member 82 is spirally voluted from a generally thicker wall section at a first end 87 of first opening 84 to a generally thinner wall section at a second end 88 of first opening 84. Similarly, wall 85 of the valve member 82 is spirally voluted from a generally thicker wall section at a first end 187 of second opening 184 to a generally thinner wall section at a second end 188 of the second opening 184. The second stage impeller 17 is arranged to rotate inside valve member 82 and the voluted interior wall surface 86.

Walls 85 of the valve member 82 are attached to and extend from the second thimble 56. A barrel member 90 having a plurality of equidistantly spaced ribs 91 is attached to the second thimble 56 with aperture 57 located centrally in the barrel 90 equidistant between the ribs 91. The ribs 91 of barrel member 90 extend vertically from the second thimble 56 and are attached to a lower surface of the first thimble 55. Barrel 90 is located within the flow feed chamber 35 and functions to transfer rotational displacement of the first valve member 42 to the second valve member 82. Ribs 91 of the barrel member 90 may be attached to thimble 55 and 56 using any common method such as for example snap-fit assembly or welding to permanently fix the ribs 91 to thimbles 55 and 56. Alternatively, the ribs 91 and the thimbles 55 and 56 can be molded as a unitary structure.

A bearing 60, preferably a ball bearing, aligns and stabilizes the first impeller 16, as well as the valve member 42 of the first pump stage 6. The bearing 60 mounts within an opening 154 extending from a skirt 155 in the center of thimble 55. The bearing 60 is pressed into opening 154 of the skirt 155 as shown in FIG. 3. The bearing 60 includes an outer race 166 engaging thimble 55 of first stage valve member 42 while an inner race 165 engages and stabilizes motor shaft 12. Bearing 60 supports both the high-speed rotation of the motor shaft 12 and the rotation of the valve assembly 40.

The exemplary first pump stage valve member 42 of the present disclosure further includes a cylindrical inlet member 77 located at an upper section 73 of valve member 42. The upper section 73 is arranged to be mounted within a mounting cavity 150 of a valve housing 31 that extends between the first pump stage 6 and the fluid inlet 36. The upper section 73 of the valve member 42 further includes an annular outer surface 76 and an internal passage 79 defined by an annular interior surface 78. The outer surface 76 of upper section 73 may include an exterior sealing assembly 25, shown at FIG. 5 consisting of a pair of elastomeric sealing members separated by a spacer. The exterior sealing assembly 25 is located circumferentially about the perimeter of outer surface 76. Interior surface 78 further includes an interior sealing assembly 26 consisting of another pair of sealing members separated by spacer as is shown at FIG. 3. The interior sealing assembly 26 is located parallel with and directly opposite from the exterior sealing assembly 25. The exterior and interior sealing assemblies are used to provide a fluid tight seal between the valve member 42 and the pump housing 31.

As is shown in FIG. 3, the upper section 73 of the valve member 42 is rotatably mounted within mounting cavity 150. The internal passage 79 receives a tubular portion 136 of fluid inlet 36 that directs fluid at low pressure to the first stage impeller 16. The exterior sealing assembly 25 seals against an interior surface 133 of mounting cavity 150. The interior sealing assembly 26 seals against surface 138 of the mounting cavity 150. The sealing assemblies 25, 26 are comprised of, for example, of O-rings fabricated from an elastomeric material such as Ethylene Propylene Diene Monomer (EPDM) rubber or the like.

The upper section 73 of the valve member 42 further includes an actuation ring 66 having a spline tooth gear band 101 attached about the periphery of the outer surface 76. As is shown in FIG. 5 the teeth of the gear band 101 are arranged to be mechanically connected to a worm gear member 104 attached to a motor shaft 102 of an actuator motor 100. The valve member 42 is rotatable about a central axis A to switch fluid flow from the first impeller cavity 50 to the first fluid outlet 34 or the second fluid outlet 38, which will be explained in more detail below. The valve member 82 being attached to the valve member 42 via ribs 91 also rotates along with the rotation of valve member 42 when valve member 42 is rotated by actuator motor 100.

With reference to FIGS. 1 and 2, the actuator motor 10) of the present disclosure is arranged to be housed within an actuator motor housing 5 of the pump section 4. The actuator motor housing 5 is integrally formed with the actuator housing 31, such as by injection molding. The actuator motor 100 is electrically connected to a remotely located controller through an electrical circuit section (not shown) on a rear face of the actuator motor 100 using an electrical connector. The controller selectively signals the actuator motor 100 to rotate motor shaft 102.

Rotation of the valve assembly 40 selectively positions the first pump stage valve member 42 to switch fluid flow from the first impeller cavity 50 to either the first or the second fluid outlets 34, 38. Simultaneously, rotation of the valve assembly 40 selectively positions the second pump stage valve member 82 to switch fluid flow from the second impeller cavity 51 to either the third or the fourth fluid outlet 39, 139.

Figure 6B:
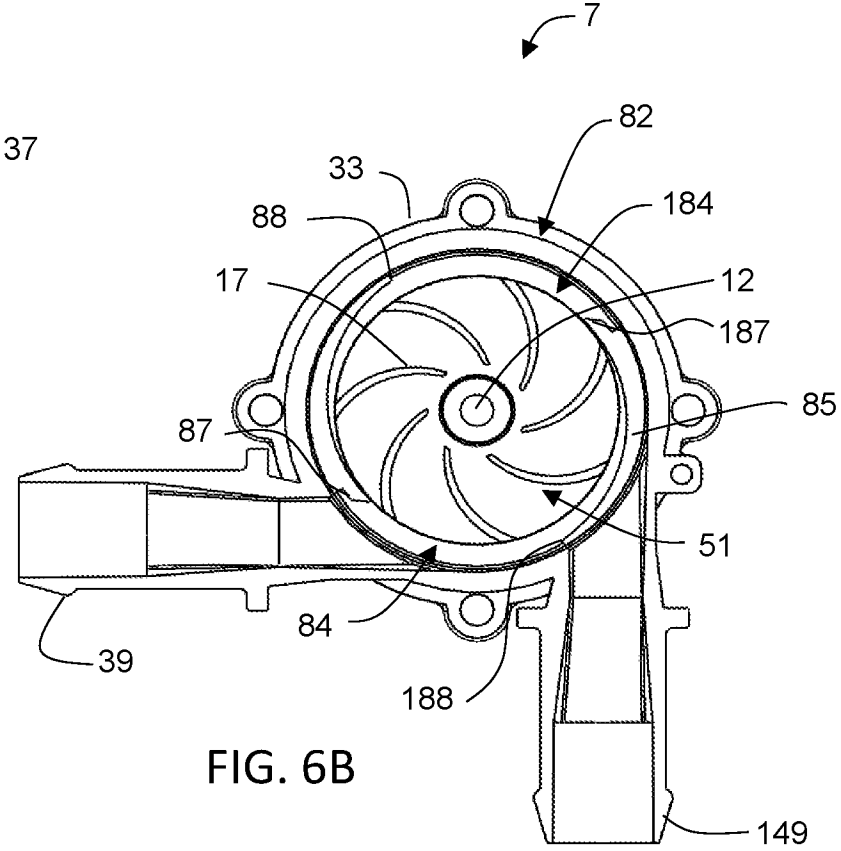
FIG. 6B illustrates a cross-sectional view of a portion of the second pump stage of the present disclosure, with the valve assembly in the first switched position.
Figure 6A:
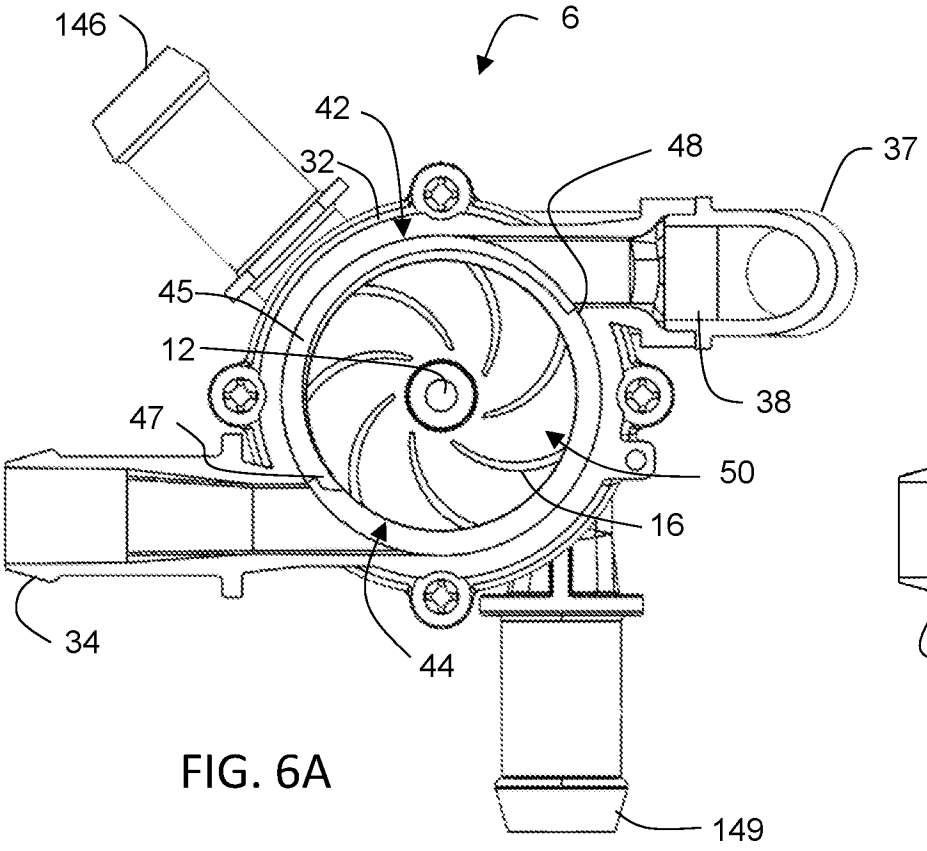
FIG. 6A illustrates a cross-sectional view through a portion of the first pump stage of the present disclosure, with the valve assembly in the first switched position.

With reference to FIGS. 6A and 6B, an exemplary operation of the first pump stage valve member 42 and the second pump stage valve member 82 will now be explained FIG. 6A illustrates schematically a section through the first pump stage 6. The first impeller cavity 50 of the first pump stage 6 includes a first stage impeller 16 rotating within valve member 42 attached to motor shaft 12 and driven by pump motor 10. The first stage impeller 16 receives fluid from fluid inlet 36 through tubular portion 136 extending through cavity 79 of the valve member 42. The first stage impeller 16 causing the fluid introduced into the first impeller cavity 50 to be accelerated within the first impeller cavity 50.

In FIG. 6A the actuator 100 selectably rotates the actuation ring 66 of valve assembly 40 to position the opening 44 of valve member 42 into a first switched position that aligns opening 44 with the first fluid outlet 34. In the first switched position fluid accelerated by the first stage impeller 16 is switched entirely through the first fluid outlet 34 from the first impeller cavity 50. Wall 45 of the valve member 42 closing off the second fluid outlet 38.

FIG. 6B illustrates schematically a section through the second pump stage 7. As was explained earlier, valve member 42 is physically fixed to valve member 82 by ribs 91 of barrel member 90. Therefore, rotation of valve member 42 by actuator 100 transfers the rotation applied to valve member 42 to valve member 82, simultaneously turning both valve members 42 and 82 synchronously. In FIG. 6B the second stage impeller 17 is attached to motor shaft 12. The second impeller 17 rotates within valve member 82 driven by pump motor 10. The second stage impeller 17 rotates at the same rotational speed as first stage impeller 16. In the first switched position, the wall 85 of the valve member 82 between first end 187 and second end 188 closes off the fourth fluid outlet 149 and opens third fluid outlet 39 to the second impeller cavity 51. Fluid introduced into the mixing chamber 35 from the second fluid inlet 146 is received into the second impeller cavity 51 through aperture 57 of thimble 56 to be accelerated by the second impeller cavity 51. With wall 45 of the first valve member 42 closing the second fluid outlet 38 from the first impeller cavity 50 no fluid from the first pump stage 6 is switched into mixing chamber 35. Only fluid entering from the second fluid inlet 146 is output from the third fluid outlet 39. Therefore, with the valve assembly 40 in the first switched position two fluid circuits may be connected to the pump assembly 1, each fluid circuit independently driven from a respective first pump stage 6 and second pump stage 7.

A 90 degree clockwise rotation of the valve assembly 40 by actuator 100 positions the valve assembly 40 into a second switched position. As is shown in FIG. 7A, rotation of the valve assembly 40 into the second switched position moves valve member 42, 90 degrees clockwise from the first switched position, however, the 90 degree rotation does not move wall 45 sufficiently to align opening 44 with second fluid outlet 38 and thereby, the second fluid outlet 34 remains closed. Fluid introduced into first impeller cavity 50 of the first pump stage 6 from fluid inlet 36 continues to be output from the first fluid outlet 34.

Figure 7B:
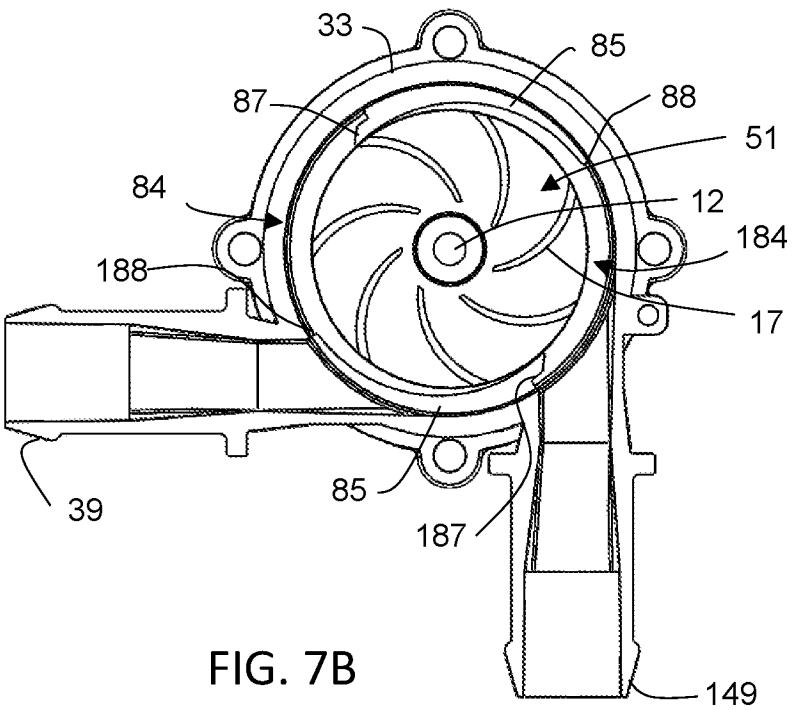
FIG. 7B illustrates a cross-sectional view through a portion of the second pump stage of the present disclosure, with the valve assembly in the second switched position.
Figure 7A:
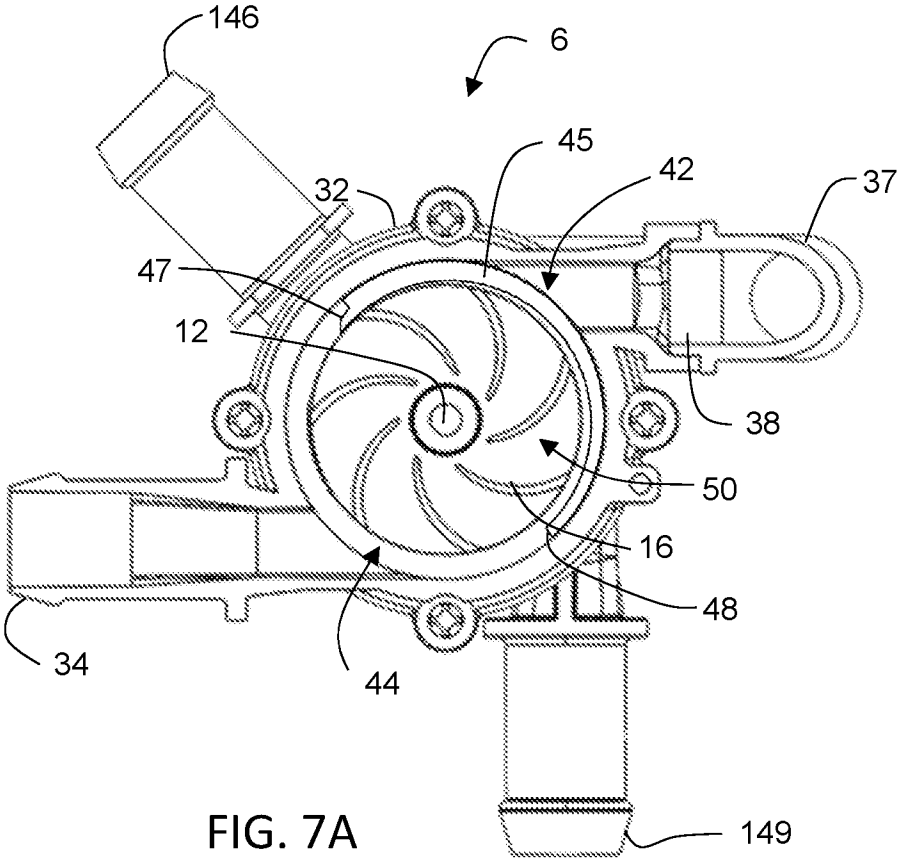
FIG. 7A illustrates a cross-sectional view of a portion of the first pump stage of the present disclosure, with the valve assembly in the second switched position.

The 90 degree clockwise rotation of the valve assembly 40 moves second opening 184 of valve member 82 to align with fourth fluid outlet 149 and wall 85 between first end 187 and second end 188 to close third fluid outlet 39, as is seen in FIG. 7B. Fluid introduced into the mixing chamber 35 from the second fluid inlet 146 is now switched to be output from the fourth fluid outlet 149. With the valve assembly 40 in the second switched position fluid in two independent fluid circuits may be connected to the pump assembly 1. Each fluid circuit independently driven from a respective first pump stage 6 and second pump stage 7, however, the second stage switches the fluid pumped by the second pump stage 7 to a different fluid circuit loop through the fourth fluid outlet 149.

A further 90 degree clockwise rotation of the valve assembly 40 by actuator 100 positions the valve assembly 40 into a third switched position. As is shown in FIG. 8A, rotation of valve assembly 40 into the third switched position moves valve member 42 wall 45 to close fluid outlet 34 and switched position opening 44 in alignment with second fluid outlet 38. Fluid introduced into the first pump stage 6 from fluid inlet 36 is accelerated by the first impeller cavity 50 through the second fluid outlet 38 and into loop 37. Loop 37 feeds the fluid from the first pump stage 6 to the mixing chamber 35.

Figure 8B:
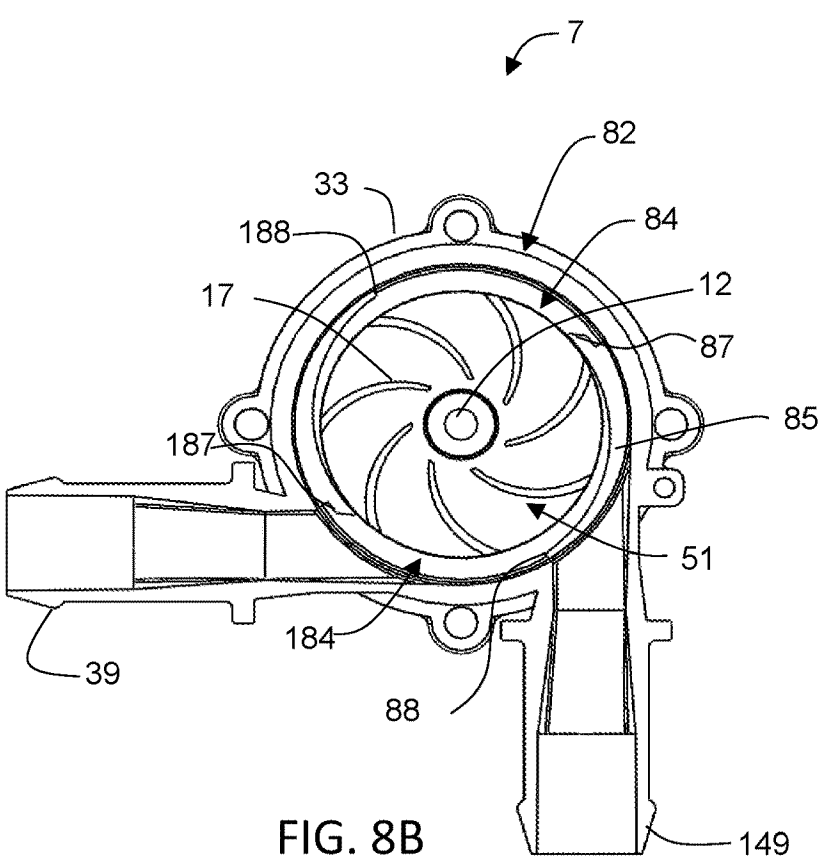
FIG. 8B illustrates a cross-sectional view through a portion of the second pump stage of the present disclosure, with the valve assembly in the third switched position.
Figure 8A:
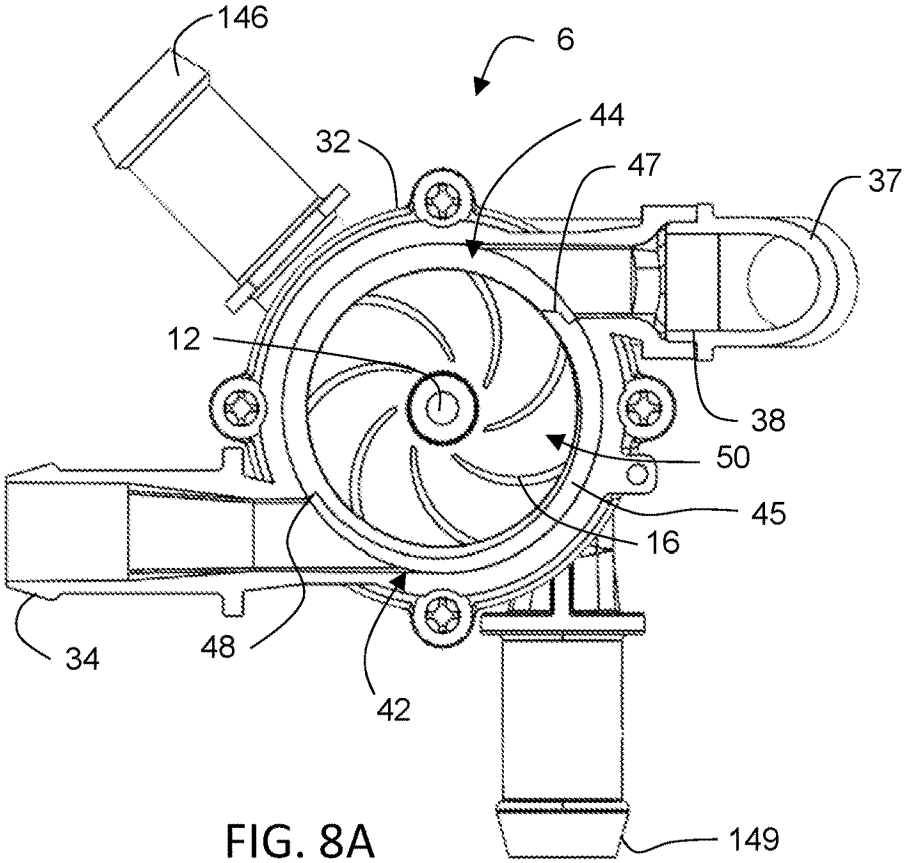
FIG. 8A illustrates a cross-sectional view of a portion of the first pump stage of the present disclosure, with the valve assembly in the third switched position.

In FIG. 8B the 90 degree clockwise rotation of the valve assembly 40 moves second opening 184 of valve member 82 to align with the third fluid outlet 39 and wall 85 between first end 87 and second end 88 to close the fourth fluid outlet 149. Fluid in the mixing chamber 35 now contains fluid from the first pump stage 6 and fluid from the second fluid inlet 146. The mixed fluid in mixing chamber 35 flows into the second impeller cavity 51 through aperture 57 of thimble 56 further accelerated by the second impeller cavity 51 and boosted to be output from the third fluid outlet 39. In the third switched position the first and second fluid circuits are mixed to provide a shared operational function such as for example cabin cooling and battery chilling from a chiller device.

A further 90 degree clockwise rotation of the valve assembly 40 by actuator 100 positions the valve assembly 40 into a fourth switched position. As is shown in FIG. 9A, rotation of the valve assembly 40 into the fourth switched position moves valve member 42, 90 degrees clockwise from the third switched position, however, the 90 degree rotation does not move wall 45 sufficiently to align opening 44 with the first fluid outlet 34 and thereby the second fluid outlet 38 remains open. Fluid introduced into first impeller cavity 50 of the first pump stage 6 from fluid inlet 36 continues to be output from the second fluid outlet 38 and through loop 37 to mixing chamber 35.

Figure 9B:
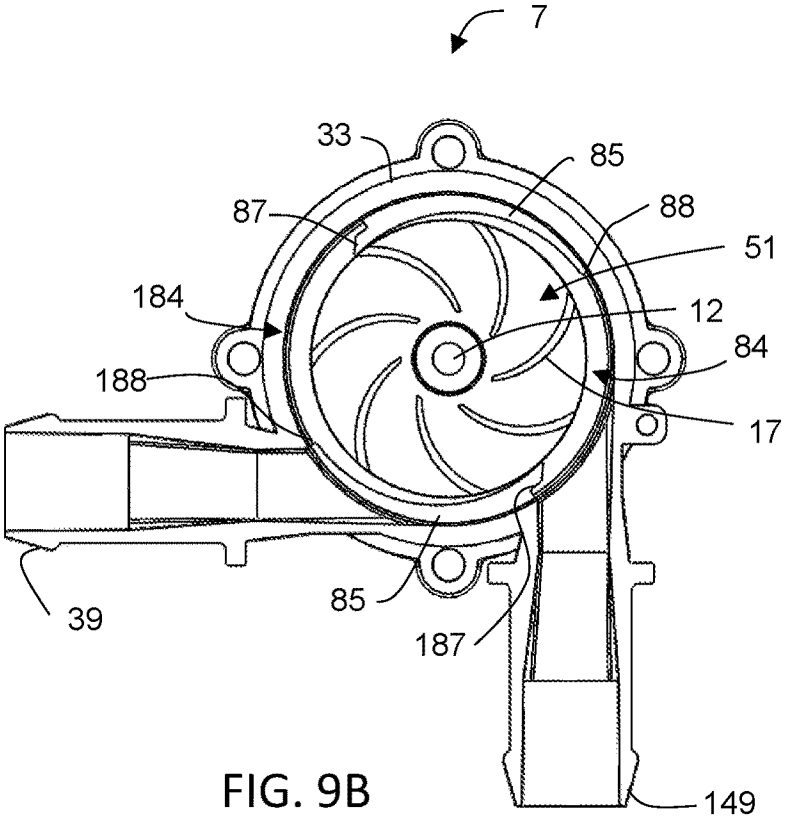
FIG. 9B illustrates a cross-sectional view through a portion of the second pump stage of the present disclosure, with the valve assembly in the fourth switched position.
Figure 9A:
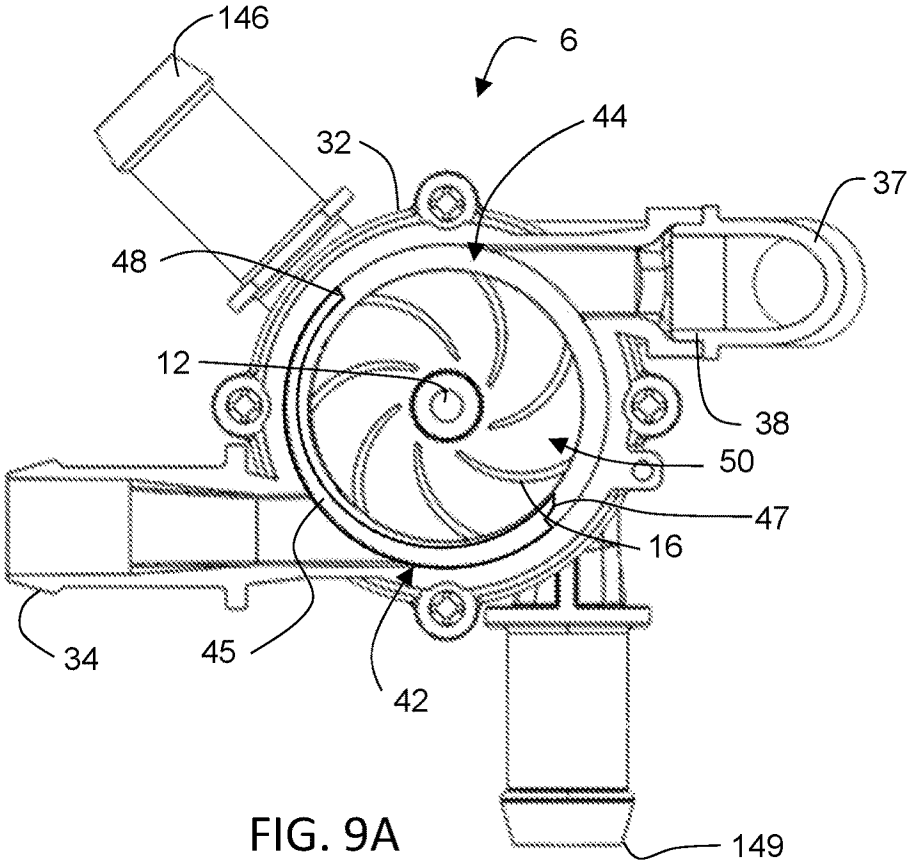
FIG. 9A illustrates a cross-sectional view of a portion of the first pump stage of the present disclosure, with the valve assembly in the fourth switched position.

In FIG. 9B the 90 degree clockwise rotation of the valve assembly 40 moves first opening 84 of valve member 82 to align with the fourth fluid outlet 149. Wall 85 between first end 187 and second end 188 closes the third fluid outlet 39. Fluid in the mixing chamber 35 is switched and further accelerated by the second impeller cavity 51 and boosted to be output from the fourth fluid outlet 149. In the fourth switched position the first and second fluid circuits are mixed to provide a shared operational function using a different fluid circuit loop such as for example cabin heating using waste heat from a battery cooling circuit.

The rotation of actuator 100 to place the valve assembly 40 in the four switched positions disclosed above does not necessarily require a clockwise direction. The example clockwise direction was used to explain the operation of the valve assembly 40. The valve assembly 40 may also operate just as well using a counterclockwise direction. For example, the actuator 100 may turn the valve assembly 40 clockwise to the second switched position from the first switched position and counterclockwise back to the first switched position or counterclockwise from the first switched position to the fourth switched position. Rotation of the actuator 100 to the various switched positions is controlled by signaling from a controller circuit operated by a user or a vehicle computer.

Even though the present disclosure has been explained using first and second pump stages, and first and second fluid outlets it will be understood by those skilled in the art, that more than two pump stages can be used to perform the functions of the present disclosure. Similarly, each pump stage may have more than first and second fluid inputs as well as more than first and second fluid outlets. Additionally, each valve member may have openings of varied sizes and configurations to provide different switched outcomes.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," or "controller" within a claim is understood and intended to refer to structures known to those skilled in the relevant art, as further modified or enhanced by the features of the claims themselves and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A pump assembly comprising:

a pump body;

a motor shaft;

a first pump stage housed in the pump body including a first impeller located in the first pump stage connected to the motor shaft, the first pump stage having a first fluid inlet and a first and a second fluid outlet;

a second pump stage housed in the pump body including a second impeller located in the second pump stage connected to the motor shaft, the second pump stage having a second fluid inlet and a third and a fourth fluid outlet;

a mixing chamber housed in the pump body between the first and the second pump stage and isolated from the first pump stage, the mixing chamber in fluid communication with the second fluid inlet and the second fluid outlet; and a valve assembly operable to:

fluidically connect the first fluid inlet through the first pump stage to the first fluid outlet and to fluidically connect the mixing chamber through the second pump stage to the third fluid outlet;

fluidically connect the first fluid inlet through the first pump stage to the second fluid outlet and to the mixing chamber wherein the fluid from the second fluid inlet and the fluid from the second fluid outlet are mixed in the mixing chamber; and fluidically connect the first fluid inlet through the first pump stage to the second fluid outlet and to fluidically connect the mixed fluid through the second pump stage to the fourth fluid outlet.

2. The pump assembly of claim 1, wherein the valve assembly is operable to fluidically connect the first fluid inlet through the first pump stage to the first fluid outlet and to fluidically connect the mixing chamber through the second pump stage to the fourth fluid outlet.

3. The pump assembly of claim 1, wherein the valve assembly is operable to fluidically connect the mixed fluid through the second pump stage to the third fluid outlet.

4. The pump assembly of claim 3, wherein the assembly further includes;

a pump motor connected to the motor shaft, and configured to rotate the motor shaft, wherein the motor shaft rotates the first impeller and the second impeller.

5. The pump assembly of claim 4, wherein the pump motor rotates the first impeller and the second impeller at the same rotational speed.

6. The pump assembly of claim 4, wherein the first fluid inlet is connected to a first fluid source and the second fluid inlet to a second fluid source when the valve assembly is operated into a first switched position and the first impeller accelerates the fluid from the first fluid source through the first pump stage to the first fluid outlet and the second impeller accelerates the fluid in the mixing chamber from the second fluid source through the second pump stage to the third fluid outlet.

7. The pump assembly of claim 4, wherein the first fluid inlet is connected to a first fluid source and the second fluid inlet to a second fluid source when the valve assembly is operated into a second switched position and the first impeller accelerates the fluid from the first fluid source through the first pump stage to the first fluid outlet and the second impeller accelerates the fluid in the mixing chamber from the second fluid source through the second pump stage to the fourth fluid outlet.

8. The pump assembly of claim 4, wherein the first fluid inlet is connected to a first fluid source and the second fluid inlet to a second fluid source when the valve assembly is operated into a third switched position and the first impeller accelerates the fluid from the first fluid source through the first pump stage to the second fluid outlet and into the mixing chamber and the second impeller further accelerates the fluid in the mixing chamber from the second fluid outlet and second fluid source through the second pump stage and boosted to the third fluid outlet.

9. The pump assembly of claim 4, wherein the first fluid inlet is connected to a first fluid source and the second fluid inlet to a second fluid source when the valve assembly is operated into a fourth switched position and the first impeller accelerates the fluid from the first fluid source through the first pump stage to the second fluid outlet and into the mixing chamber and the second impeller further accelerates the fluid in the mixing chamber from the second fluid outlet and second fluid source through the second pump stage and boosted to the fourth fluid outlet.

10. The pump assembly of claim 9, wherein the valve assembly is operated into the first, second, third and fourth switched positions by an actuator.

11. The pump assembly of claim 10, wherein the valve assembly includes a first valve member rotationally mounted between the first impeller and the first and second outlets of the first pump stage, the first valve member including a thimble attached to the first valve member bottom surface the first valve member thimble including a bearing fixed to the motor shaft and the first valve member thimble, the first valve member including a peripheral wall having an opening through the wall for fluidically connecting the first or the second fluid outlets to the impeller.

12. The pump assembly of claim 11, wherein the actuator rotates the first valve member to the first and the second switched position aligning the first valve opening to fluidically connect the first impeller to the first fluid outlet and the first valve member wall to fluidically disconnect the first impeller from the second fluid outlet.

13. The pump assembly of claim 11, wherein the actuator rotates the first valve member to the third and fourth switched positions aligning the first valve opening to fluidically connect the first impeller to the second fluid outlet and the first valve member wall to fluidically disconnect the first impeller from the first fluid outlet.

14. The pump assembly of claim 10, wherein the valve assembly includes a second valve member fixed to the first valve member and rotationally mounted between the second impeller and the third and fourth fluid outlets of the second pump stage, the second valve member including an aperture extending through a thimble mounted to the top surface of the second valve member, the aperture fluidically connecting the second impeller to the mixing chamber, the second valve member further including a peripheral wall having a first and a second opening through the wall.

15. The pump assembly of claim 14, wherein the second valve member rotates to the first valve position when the actuator rotates the first valve member to the first switched position the second valve member first opening fluidically connecting the second impeller to the third fluid outlet and the second valve member wall to fluidically disconnecting the second impeller from the fourth fluid outlet.

16. The pump assembly of claim 14, wherein the second valve member rotates to the second switched position when the actuator rotates the first valve member to the second switched position the second valve member second opening fluidically connecting the second impeller to the fourth fluid outlet and the second valve member wall fluidically disconnecting the second impeller from the third fluid outlet.

17. The pump assembly of claim 14, wherein the second valve member rotates to the third switched position when the actuator rotates the first valve member to the third switched position the second valve member second opening fluidically connecting the second impeller to the third fluid outlet and the second valve member wall fluidically disconnecting the second impeller from the fourth fluid outlet.

18. The pump assembly of claim 14, wherein the second valve member rotates to the fourth switched position when the actuator rotates the first valve member to the fourth switched position the second valve member first opening fluidically connecting the second impeller to the fourth fluid outlet and the second valve member wall to fluidically disconnecting the second impeller from the third fluid outlet.

19. A method for switching fluid flow through a pump assembly, the method comprising rotating a motor shaft;

housing in the pump assembly a first pump stage having a first impeller connected to and rotated by the motor shaft for pumping fluid through the first pump stage and a second pump stage having a second impeller connected to and rotated by the motor shaft for pumping fluid through the second pump stage;

moving a valve assembly into a first switched position to fluidically connect a first fluid inlet and a first fluid source to the first pump stage, the first pump stage having a first and a second fluid outlet, the first switched position fluidically connecting the first fluid outlet to the first pump stage, wherein the first pump stage pumps fluid from the first fluid source to the first fluid outlet;

fluidically connecting a mixing chamber housed in the pump assembly between the first pump stage and isolated from the first pump stage to the second pump stage, the mixing chamber fluidically connected to a second fluid inlet and to a second fluid source, the second pump stage having third and fourth fluid outlets and the first switched position fluidically connecting the third fluid outlet to the second pump stage, wherein the second pump stage pumps fluid from the second fluid source to the third fluid outlet;

moving the valve assembly into a second switched position fluidically disconnecting the second pump stage from the third fluid outlet and fluidically connecting the second pump stage to the fourth fluid outlet, wherein the fluid from the second fluid source is pumped to the fourth fluid outlet;

moving the valve assembly into a third switched position to fluidically connect the first fluid inlet and the first fluid source to the second fluid outlet and to fluidically disconnect the first pump stage from the first fluid outlet, the first pump stage pumping fluid from the first fluid source to the mixing chamber where it is mixed with the fluid from the second fluid inlet and the second fluid source and the valve assembly in the third switched position fluidically connects the mixing chamber to the second pump stage and the third fluid outlet disconnecting the second pump stage from the fourth fluid outlet, wherein the second pump stage accelerates and boosts the mixed fluid to the third fluid outlet; and moving the valve assembly into a fourth position fluidically disconnecting the second pump stage from the third fluid outlet and fluidically connecting the second pump stage to the fourth fluid outlet, wherein the second pump stage accelerates and boosts the mixed fluid to the fourth fluid outlet.

* * * * *